US011377257B2

(12) United States Patent
Siao et al.

(10) Patent No.: US 11,377,257 B2
(45) Date of Patent: Jul. 5, 2022

(54) CONTAINER SET HAVING A LOCKING STRUCTURE

(71) Applicant: JING SI PURELAND CO., LTD., Taipei (TW)

(72) Inventors: Marshall Q. Siao, Xincheng Township (TW); Ronald Tuan, Nantou (TW)

(73) Assignee: JING SI PURELAND CO., LTD., Taipei (TW)

( * ) Notice: Subject to any disclaimer, the term of this patent is extended or adjusted under 35 U.S.C. 154(b) by 73 days.

(21) Appl. No.: 17/131,601

(22) Filed: Dec. 22, 2020

(65) Prior Publication Data

US 2021/0198008 A1 Jul. 1, 2021

(30) Foreign Application Priority Data

Dec. 30, 2019 (TW) ..... 108148448

(51) Int. Cl.
*B65D 21/06* (2006.01)
*B65D 43/02* (2006.01)
(Continued)

(52) U.S. Cl.
CPC ..... *B65D 21/068* (2013.01); *B65D 43/021* (2013.01); *B65D 51/1644* (2013.01);
(Continued)

(58) Field of Classification Search
CPC ..... B65D 51/18; B65D 43/021; B65D 2543/00092; B65D 2543/00046; B65D 2543/0049; B65D 2543/000972; B65D 2543/00231; B65D 2543/0025; B65D 2543/00435; B65D 2543/00564; B65D 47/08; B65D 47/0857; B65D 47/0873; B65D 47/088; B65D 47/0885; B65D 47/089; B65D 47/0895; B65D 47/286; B65D 47/32; B65D 43/20; B65D 51/16;
(Continued)

(56) References Cited

FOREIGN PATENT DOCUMENTS

CN 205568137 U * 9/2016
CN 205568137 U 9/2016
(Continued)

OTHER PUBLICATIONS

Search Report completed Apr. 7, 2021 for European Patent Application EP20216723.

*Primary Examiner* — John K Fristoe, Jr.
*Assistant Examiner* — John Martin Hoppmann
(74) *Attorney, Agent, or Firm* — Holzer Patel Drennan

(57) ABSTRACT

A container set includes a cover, a base, the cover having a cover sealing member which is made of elastic material and protrudes from a cover peripheral edge of the cover to allow the cover to engage the base, and a first container received between the cover and the base and having a container edge to allow the first container to engage an inner surface of the cover. In addition, the inner surface of the base has a base groove to allow the cover sealing member to engage the base groove when the cover engages the base, wherein the container edge, the cover sealing member and the base groove constitute an interlocking structure. With this interlocking structure, the cover, the base and the container(s) located therebetween can form a tightly engaged container set.

13 Claims, 6 Drawing Sheets

(51) Int. Cl.
*B65D 51/16* (2006.01)
*B65D 53/02* (2006.01)

(52) U.S. Cl.
CPC .... *B65D 53/02* (2013.01); *B65D 2543/00092* (2013.01); *B65D 2543/00564* (2013.01)

(58) Field of Classification Search
CPC ..... B65D 2543/00194; B65D 51/56; A47G 19/2272; A24F 23/00; A24F 23/04
USPC ..... 220/715, 714, 780, 796, 254.9, 713, 220/345.3
See application file for complete search history.

(56) References Cited

FOREIGN PATENT DOCUMENTS

| | | | | | |
|---|---|---|---|---|---|
| CN | 208842924 | U | * | 5/2019 | ..... A45D 33/003 |
| CN | 110267885 | A | | 9/2019 | |
| CN | 110464179 | A | * | 11/2019 | ..... A45F 3/20 |
| TW | 342093 | U | | 10/2008 | |
| WO | 2018169555 | A1 | | 9/2018 | |
| WO | WO-2019096007 | A1 | * | 5/2019 | ..... A45F 3/20 |

* cited by examiner

CONTAINER SET HAVING A LOCKING STRUCTURE

CROSS REFERENCE TO RELATED APPLICATIONS

This application claims priority of Taiwan Patent Application No. 108148448, filed on Dec. 30, 2019, the entirety of which is incorporated by reference herein.

TECHNICAL FIELD

The present invention relates to a container set, and more particularly to a container set having a locking structure.

BACKGROUND

For convenience, a container set for portable use, having a number of containers (e.g., cups, dishes etc.) of different sizes stacked and received in a case, is commonly available. However, in use, the containers may not be cleaned immediately after use. The used containers must be stacked and stowed, then taken home and washed. Consequently, poor sealing properties of the case can lead to a problem of leakage from the used cups and dishes, which may also experience unwanted vibration and agitation during transport, lacking secure fixing within the case.

In addition, the containers not being collapsible results in a bulky profile for the set, inconveniencing users.

A container set of the present invention provides a locking structure enabling containers therein to firmly engage with a cover and a base and preventing liquid leakage therefrom. The locking structure may also stabilize the containers, and utensils may be further secured in the stowed containers. Finally, the containers within the container set are collapsible, optimizing space utilization of the container set.

SUMMARY OF INVENTION

According to one aspect of the invention, the invention provides a container set including a cover and base. The cover has a cover sealing member of elastic material protruding from a cover peripheral edge of the cover to engage the base.

In one aspect of the invention, the cover sealing member protrudes outward along the cover peripheral edge to engage an inner surface of the base.

In one aspect of the invention, the inner surface of the base has a base groove to allow the cover sealing member to engage the base groove when the cover engages the base.

In one aspect of the invention, the container set further includes a first container having a container edge to allow the first container to engage an inner surface of the cover.

In one aspect of the invention, the cover sealing member extends along the cover peripheral edge and protrudes inward, and the container edge extends along a peripheral edge of the first container and protrudes outward to allow the first container to engage the cover through an engagement between the container edge and the cover sealing member.

In one aspect of the invention, the container edge, the cover sealing member and the base groove constitute an interlocking structure.

In one aspect of the invention, when the container edge engages the cover sealing member and when the cover sealing member engages the base groove, both the container edge and the base groove abut against the cover sealing member so that a seal is formed by the interlocking structure resulting from elastic deformation of the cover sealing member.

In one aspect of the invention, the container set further includes a second container placed between the first container and the cover.

In one aspect of the invention, an inner surface of the cover sealing member forms a cover groove extending along the cover peripheral edge, and when the first container engages the cover, the container edge engages the cover groove.

In one aspect of the invention, the cover groove is defined by at least one inner projection of the cover sealing member and the inner surface of the cover.

In one aspect of the invention, the elastic material is silicon rubber.

In one aspect of the invention, the elastic material is attached to the cover sealing member by coating.

In one aspect of the invention, the first container and the second container are foldable, and each of the first container and the second container includes a bottom portion and a top portion made of a first material, a middle portion made of a second material and having at least two folding segments, wherein the middle portion is located between the bottom portion and the top portion and connected to a top edge of the bottom portion and a bottom edge of the top portion respectively, and the first material has a higher Young's modulus than that of the second material.

In one aspect of the invention, the second material is silicon rubber.

In one aspect of the invention, the at least two folding segments comprise a first folding segment and a second folding segment, wherein the first folding segment is located adjacent to a position where the middle portion and the bottom portion join, and the second folding segment is located adjacent to a position where the middle portion and the top portion join, and wherein when the first container and the second container are folded, the first folding segment and the second folding segment are elastically deformed so that the bottom portion is folded and received at an inner side of the top portion, and the middle portion is folded between the top portion and the bottom portion.

In one aspect of the invention, the cover has a gas valve.

In one aspect of the invention, the container set further includes at least one utensil placed between the first container and the base.

To enable those skilled in the art to better understand the features of the invention and carry out the claimed invention, detailed description for the embodiments is provided along with the drawings. The description only serves to describe the preferable embodiments of the invention and does not impose any restrictions thereon. Any modifications or variations made in the same spirit of the invention shall lie within the scope of protection of the invention.

DETAILED DESCRIPTION

Figure 1:
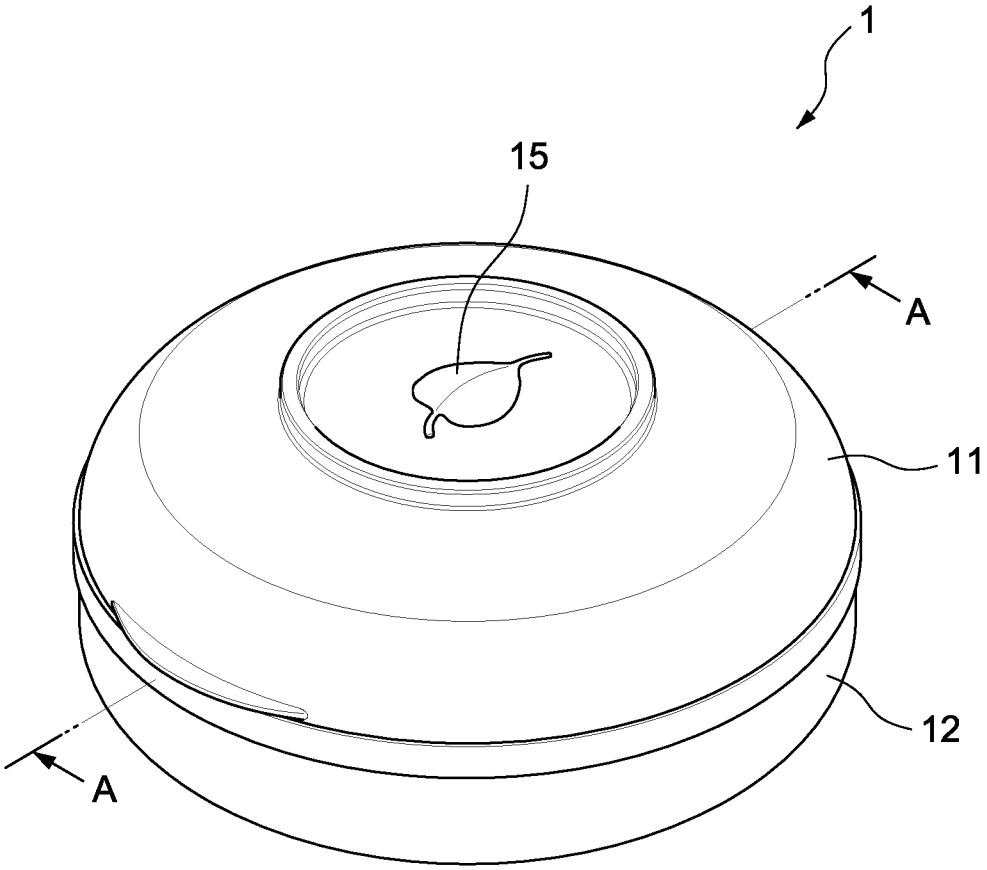
FIG. 1 is a perspective view of a container set of a preferable embodiment of the invention after the container set is assembled.

FIG. 1 is a schematic view of a container set 1 in accordance with one preferable embodiment of the present invention.

As shown in FIG. 1, the container set 1 includes a cover 11 and a base 12. Although the cross sections of each cover 11 and the base 12 shown in the figures are circular, they can be of various shapes, such as polygonal, circular, and elliptical.

Figure 2:
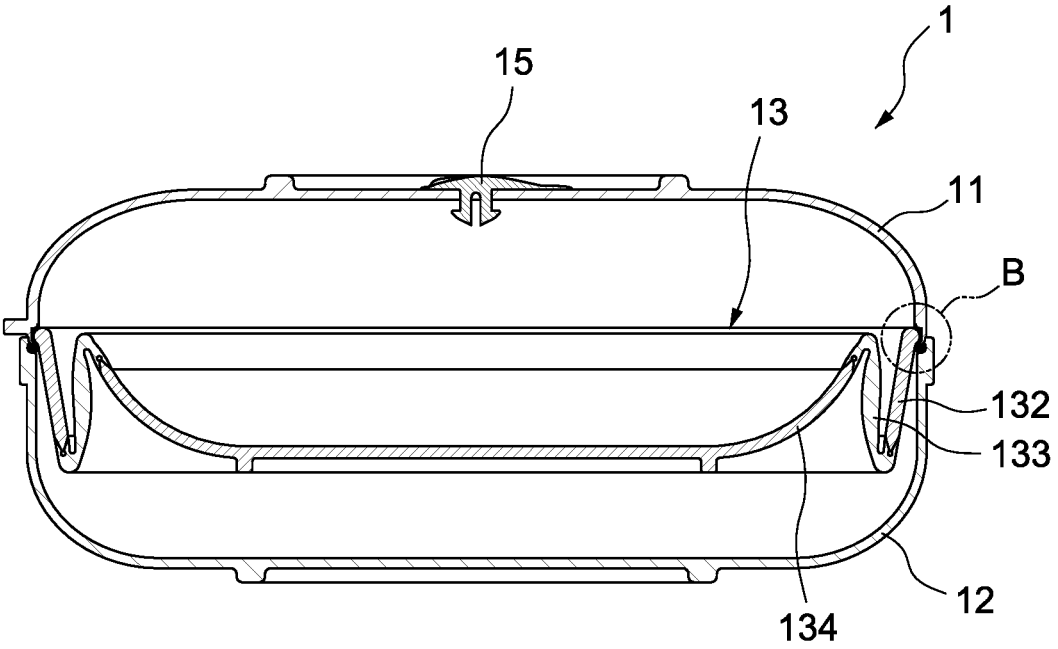
FIG. 2 is a cross-sectional view of the container set taken along line A-A in FIG. 1.
Figure 3:
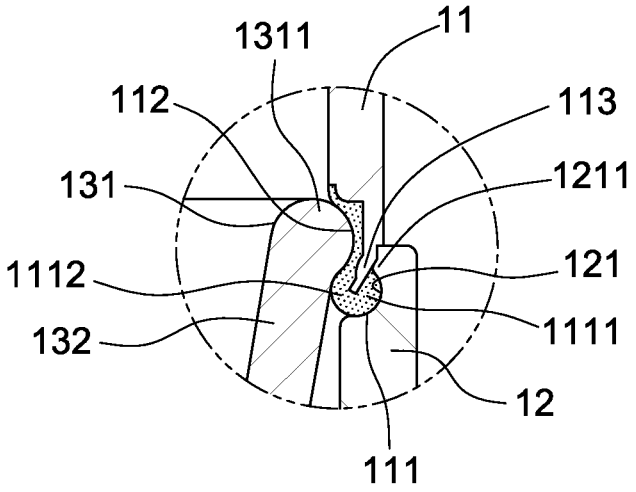
FIG. 3 is a partially enlarged view of a portion B shown in FIG. 2.

FIG. 2 is a cross-sectional view of the container set 1 taken along line A-A in FIG. 1. FIG. 3 is a partially enlarged view of a portion B shown in FIG. 2, wherein a cover sealing member 111 made of elastic material protrudes along a cover peripheral edge 113 of the cover 11.

In the embodiment, the cover sealing member 111 may be attached to the cover peripheral edge 113 by gluing, clamping, or coating. Preferably, the cover sealing member 111 is attached to the cover peripheral edge 113 by coating, thereby a seal is formed between the cover sealing member 111 and the cover peripheral edge 113 due to properties of the elastic material, so as to prevent mold or dust between the cover sealing member 111 and the cover peripheral edge 113 and to prevent the cover sealing member 111 from being separated from the cover peripheral edge 113. The elastic material may be silicone rubber or rubber. Preferably, the elastic material is silicone rubber.

As shown in FIGS. 2 and 3, the cover sealing member 111 protrudes from the cover peripheral edge 113 of the cover 11, and the cover 11 can engage the base 12 through the cover sealing member 111 to form a sealed container. In the embodiment, the cover sealing member 111 forms an outer projection 1111 having a substantially curved cross section. In addition, as shown in FIG. 3, an outer diameter of the cover peripheral edge 113 of the cover 11 is slightly smaller than an outer diameter of a peripheral edge of the base 12, so that the cover 11 can engage an inner surface of the base 12 through the cover sealing member 111 that protrudes outward.

Figure 4:
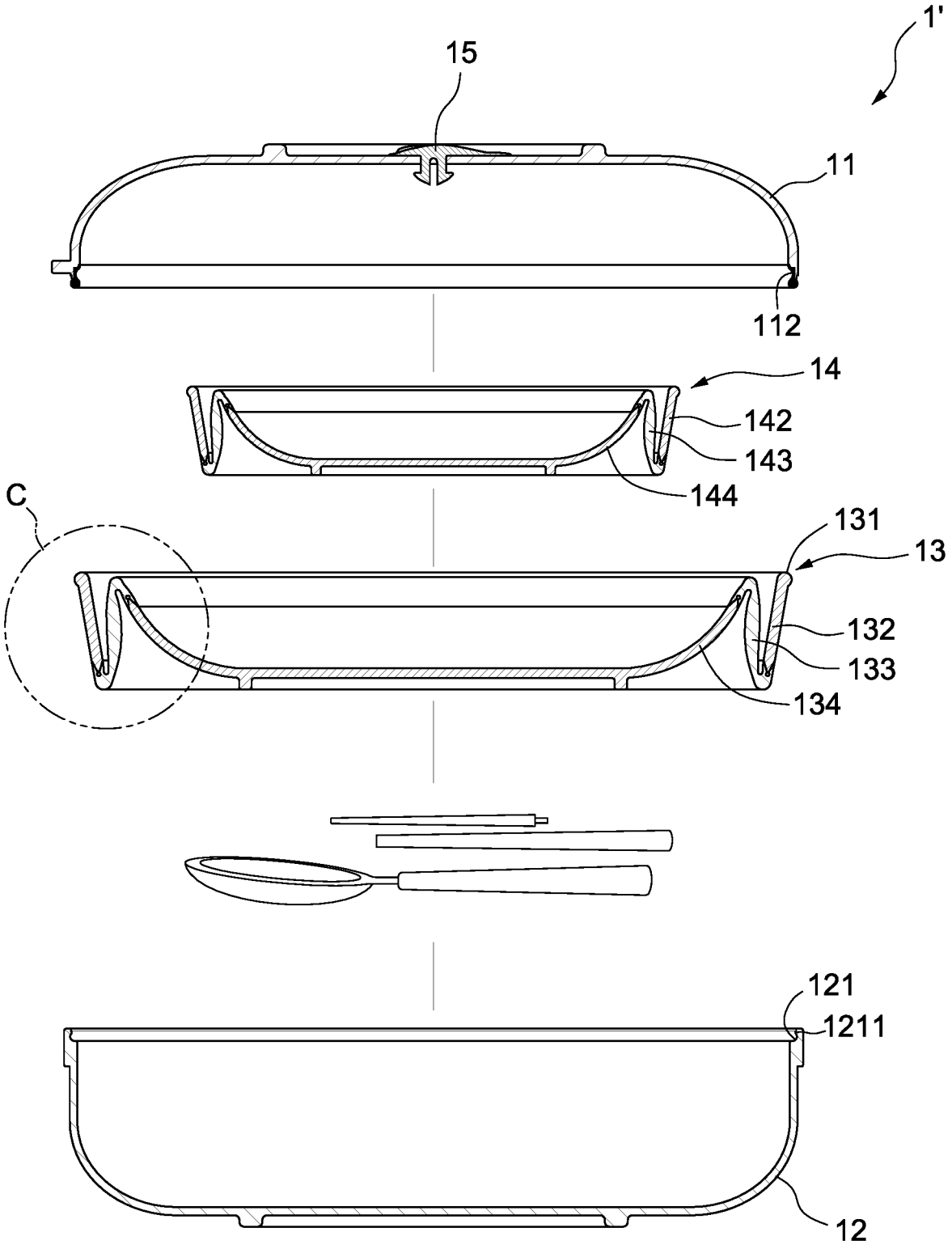
FIG. 4 is an exploded view of the container set of the other preferable embodiment of the invention, which is based on FIG. 1 with second container and utensils added.

As shown in FIGS. 2-4, in the embodiment, the inner surface of the base 12, which is adjacent to the peripheral edge of the base 12, has a base groove 121 extending along the peripheral edge of the base 12. When the cover 11 engages the base 12, the cover sealing member 111 can engage the base groove 121.

The base groove 121 of the base 12 further includes a projection 1211 which has a substantially curved cross section. When the cover 11 engages the base 12, the outer projection 1111 of the cover sealing member 111 is engaged between the base groove 121 and the projection 1211. In such case, the outer projection 1111 of the cover sealing member 111 is elastically deformed due to the compression by the projection 1211 and the base groove 121, so that the outer projection 1111 of the cover sealing member 111 is subject to an upward holding force (from the base groove 121) and a downward holding force (from the projection 1211) to create the seal between the cover 11 and the base 12.

In the embodiment, the projection 1211 is integrally formed with the base groove 121. In other preferable embodiments of the present disclosure, the projection 1211 can be also independently made of elastic material, such as silicone rubber or rubber, etc. In such case, the projection 1211 can be attached to the base groove 121 through gluing, clamping, or coating. Preferably, the projection 1211 is attached to the base groove 121 through coating.

Additionally, in the embodiment, the base groove 121 and/or the projection 1211 located on the inner surface of the base 12 extends along a peripheral edge of the inner surface of the base 12 so as to provide a greater holding force on the cover 11 and the base 12.

As shown in FIGS. 1-4, the container set 1 of the current embodiment further includes a first container 13 which can be placed between the cover 11 and the base 12. The first container 13 has a container edge 131 so that the first container 13 can abut against an inner surface of the cover 11 through the container edge 131.

As shown in FIG. 3, in the embodiment, the container edge 131 extends along a peripheral edge of the first container 13 and protrudes outward, so that the first container 13 engages the cover 11 through engagement of the container edge 131 and the cover sealing member 111. Preferably, the cover sealing member 111 further has an inner projection 1112 protruding inward and having a curved cross section, the container edge 131 has a projection 1311 protruding outward and having a curved cross section, and an outer diameter of the projection 1311 of the container edge 131 exceeds an inner diameter of the inner projection 1112 of the cover sealing member 111. When the first container 13 engages the cover 11, the projection 1311 of the container edge 131 is engaged on the inner projection 1112 of the cover sealing member 111 by elastically deforming the inner projection 1112 of the cover sealing member 111. As a result, the container edge 131 and the cover sealing member 111 are firmly fastened.

In the embodiment, the inner projection 1112 and the outer projection 1111 of the cover sealing member 111 are integrally formed and attached to the cover peripheral edge 113 through, for example, gluing, clamping, or coating.

In other preferable embodiments, the outer projection 1111 and the inner projection 1112 of the cover sealing member 111 are individually made of elastic material. The outer projection 1111 and the inner projection 1112 can be attached to the cover sealing member 111 through gluing, clamping or coating. Preferably, the outer projection 1111 and the inner projection 1112 are attached to the cover sealing member 111 through coating.

In this embodiment, the container edge 131 and the projection 1311 are made of hard material. In other embodiments, the container edge 131 and the projection 1311 can be made of elastic material, such as silicone rubber or rubber, etc. The elastic material can be attached to the container edge 131 through gluing, clamping or coating. Preferably, the elastic material is attached to the container edge 131 through coating.

As shown in FIG. 3, through the structures of the cover 11, the base 12 and the first container 13, when the container edge 131 engages the cover sealing member 111 and the cover sealing member 111 is also engaged with the base groove 121, the container edge 131 and the base groove 121 respectively abut against an inner side and an outer side of the cover sealing member 111 to make the cover sealing member 111 elastically deform, so as to form a sealed interlocking structure.

Specifically, when the cover 11, the base 12 and the first container 13 are assembled, the projection 1311 of the container edge 131 engages the inner projection 1112 of the cover sealing member 111, and the cover sealing member 111 (or the outer projection 1111) is simultaneously engaged with the base groove 121. At this time, the projection 1311 of the container edge 131 abuts against the inner projection 1112 of the cover sealing member 111, the projection 1211 of the base groove 121 abuts against the outer projection 1111 of the cover sealing member 111, and the outer projection 1111 of the cover sealing member 111 (which may include the inner projection 1112) abuts against the base groove 121 simultaneously, such that the container edge 131, the cover sealing member 111, and the base groove 121 form the sealed interlocking structure through the elastic deformation of the outer projection 1111 and the inner projection 1112 (the reliability of the seal would be improved by elastic deformation as the projection 1311 is also made of elastic material).

As shown in FIG. 3, in another embodiment of the invention, the container set has a similar structure to that of forgoing embodiment, wherein an inner surface of the cover sealing member 111 further forms a cover groove 112 which extends along the cover peripheral edge 113 of the cover 11. When the first container 13 engages the cover 11, the container edge 131 engages the cover groove 112, so that the cover groove 112 holds the container edge 131.

In one preferable embodiment of the invention, the cover groove 112, the inner projection 1112 and/or the outer projection 1111 can be a single component formed integrally.

In one preferable embodiment of the invention, the cover groove 112 is defined by the inner projection 1112 of the cover sealing member 111 and the inner surface of the cover 11.

In one preferable embodiment of the invention, when the cover 11 engages the first container 13, the projection 1311 of the first container 13 is engaged between the cover groove 112 and the inner projection 1112, and the projection 1311 of the first container 13 simultaneously abuts against the cover groove 112 and the inner projection 1112. As such, the projection 1311 of the first container 13 is subject to an upward holding force (from the inner projection 1112) and a downward holding force (from the cover groove 112) at the same time through an elastic deformation of the inner projection 1112 so as to create the seal between the cover 11 and the base 12.

Figure 6:
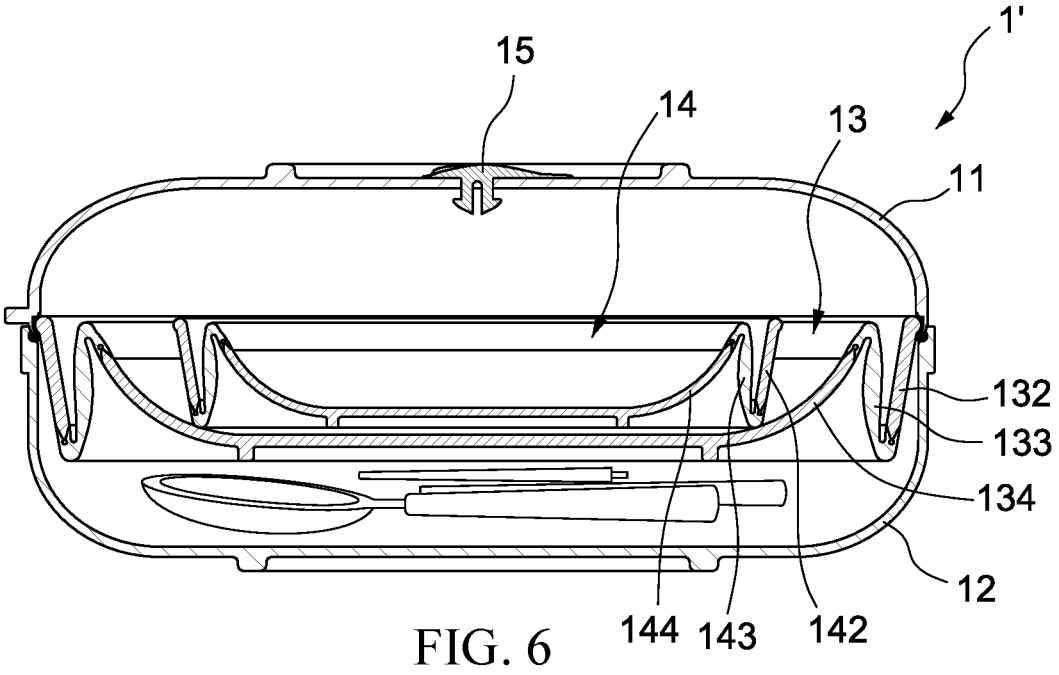
FIG. 6 is a cross-sectional view of the container set shown in FIG. 4 after being assembled.

As shown in FIGS. 4 and 6, in another preferable embodiment of the invention, the container set 1' further includes a second container 14. The second container 14 may be placed between the first container 13 and the cover 11.

As shown in FIGS. 4-7, in this embodiment, the first container 13 and the second container 14 are foldable. The first container 13 includes a bottom portion 134, a top portion 132 and a middle portion 133, and the second container 14 includes a bottom portion 144, a top portion 142 and a middle portion 143. The bottom portions 134 and 144 and the top portions 132 and 142 are made of a first material, and the middle portions 133 and 143 are made of a second material. In addition, the middle portions 133 and 143 are respectively located between the bottom portions 134 and 144 and the top portions 132 and 142 and respectively connect top edges of the bottom portions 134 and 144 and bottom edges of the top portions 132 and 142.

Figure 5:
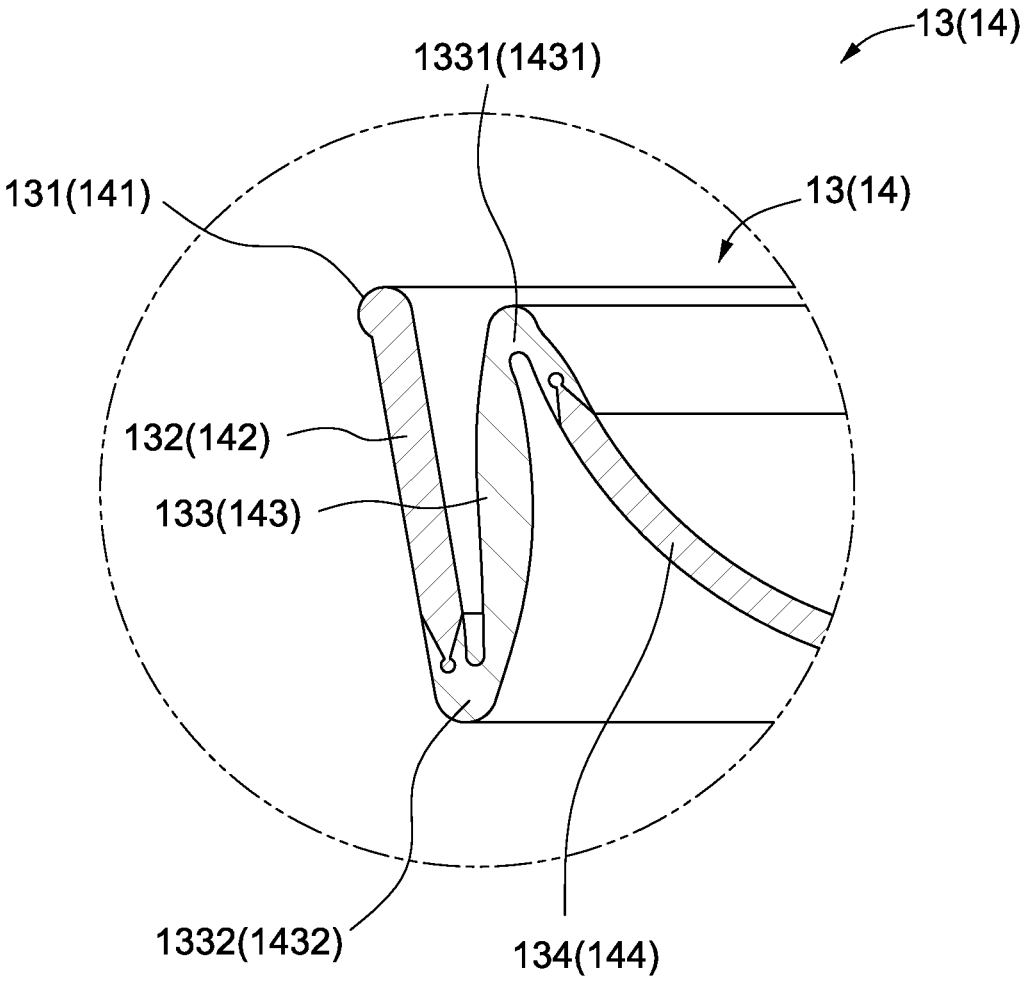
FIG. 5 is a partial enlarged view of a portion C shown in FIG. 4.
Figure 8:
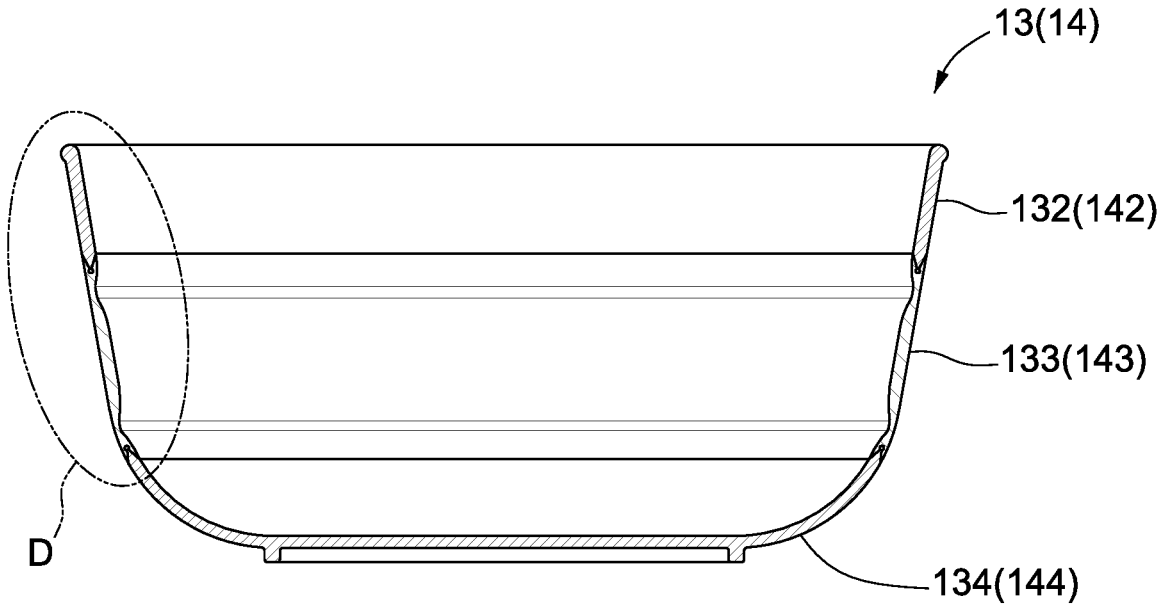
FIG. 8 is a cross-sectional view of the container shown in FIG. 7.
Figure 9:
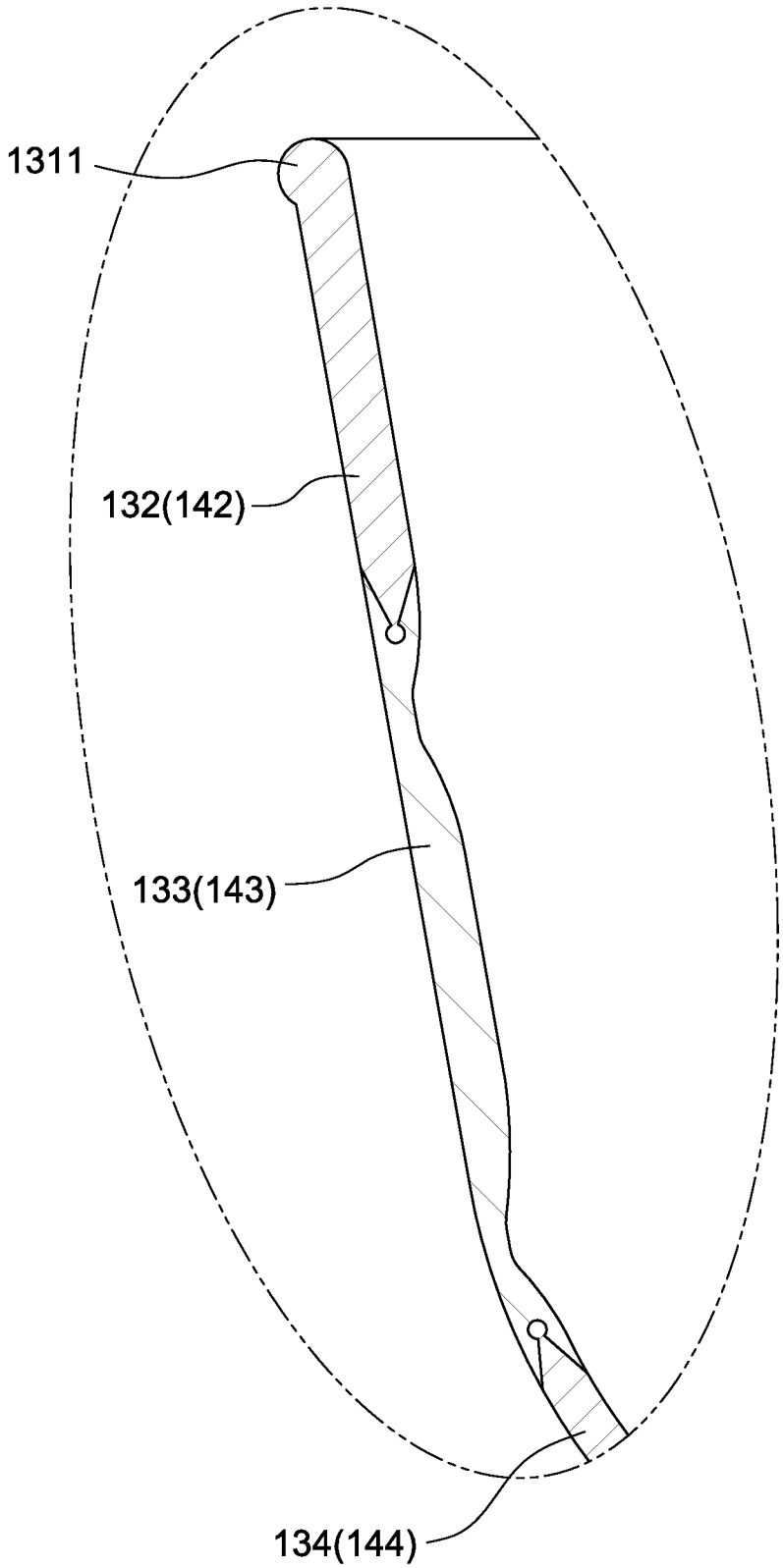
FIG. 9 is a partial enlarged view of a portion D shown in FIG. 8.

As shown in FIGS. 5, 8 and 9, in the current embodiment, the middle portion 133 and the middle portion 143 respectively include at least two folding segments 1331 and 1332 and at least two folding segments 1431 and 1432. The folding segments 1331 and 1332 are respectively connected to the top edge of the bottom portion 134 and the bottom edge of the top portion 132 through gluing, clamping, or coating, and the folding segments 1431 and 1432 are respectively connected to the top edge of the bottom portion 144 and the bottom edge of the top portion 142 through gluing, clamping, or coating.

Additionally, the first material has a higher Young's modulus than the second material. Preferably, the first material is made of hard material, and the second material is made of pliable material or elastic material, such as rubber or silicone rubber, etc. In one preferable embodiment, the second material is made of silicon rubber.

Moreover, as shown in FIGS. 4 and 6, the first container 13 and the second container 14 have similar foldable structures. The first container 13 and the second container 14 may have different sizes so that multiple containers are able to be stacked and received within the space formed between the cover 11 and the base 12.

In the embodiments set forth above, the folding segments 1331 and 1431 of the first and second containers 13 and 14 are referred to as first folding segments 1331 and 1431, and the folding segments 1332 and 1432 of the first and second containers 13 and 14 are referred to as second folding segments 1332 and 1432. The first folding segment 1331 is located adjacent to a position where the middle portion 133 and the bottom portion 134 join, and the first folding segment 1431 is located adjacent to a position where the middle portion 143 and the bottom portion 144 join. The second folding segment 1332 is located adjacent to a position where the middle portion 133 and the top portion 132 join, and the second folding segment 1432 is located adjacent to a position where the middle portion 143 and the top portion 142 join. When the first container 13 and the second container 14 are folded, the first folding segments 1331 and 1431 and the second folding segments 1332 and 1432 are elastically deformed so that the bottom portions 134 and 144 are folded and received at inner sides of the top portions 132 and 142 respectively, and the middle portions 133 and 143 are folded in between the top portions 132 and 142 and the bottom portions 134 and 144 respectively.

As shown in FIGS. 2, 4 and 6, in a preferable embodiment of the invention, the cover 11 has a gas valve 15 which facilitates a tighter seal between the cover 11 and the base 12 and prevents the cover 11 from being separated from the base 12. In addition, when the cover 11 is to be detached from the base 12, the gas valve 15 may be released to equalize pressure inside and outside of the container.

As shown in FIGS. 4 and 6, in a preferable embodiment of the invention, the container set may further include utensils such as knives, forks, chopsticks, spoons, etc., accommodated within the space formed between the cover 11 and the base 12. Preferably, the utensils are accommodated between the first container 13 and the base 12.

Figure 7:
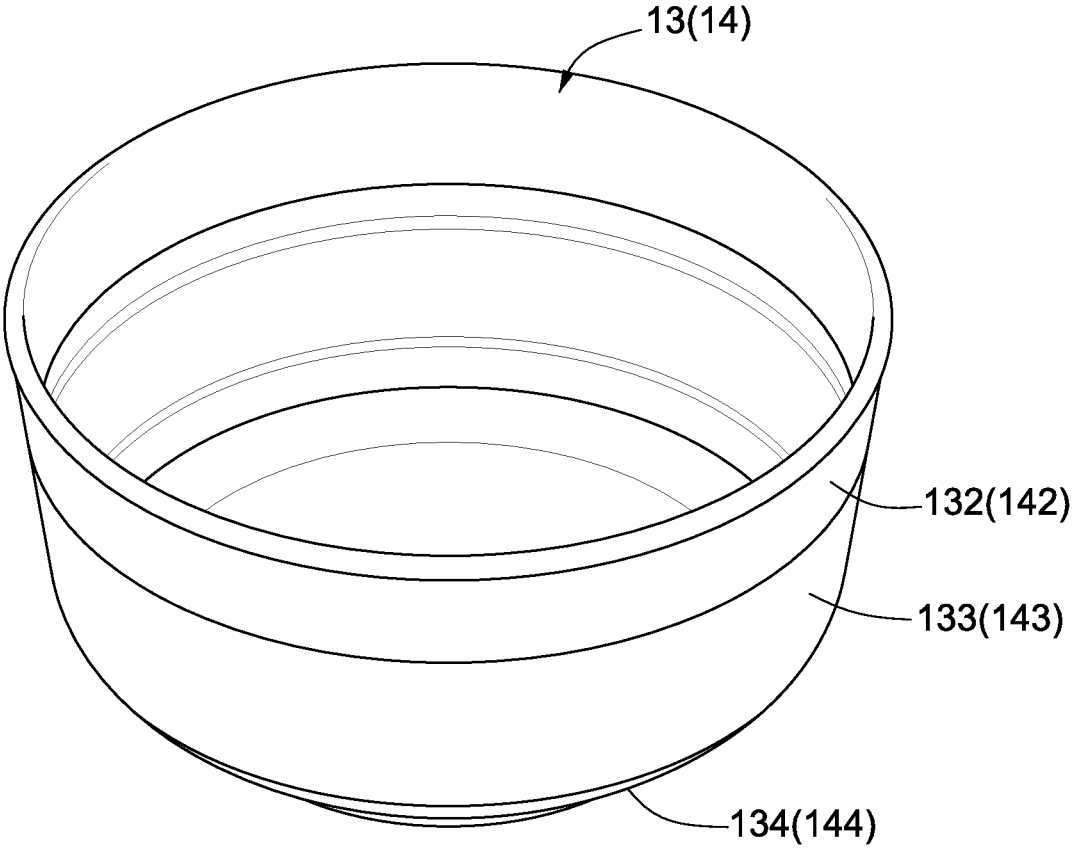
FIG. 7 is a schematic view of the container shown in FIG. 4 after being developed.

As shown in FIGS. 4-7, to use the container sets 1 and 1', the user may detach the cover 11 from the base 12 (at this time the first container 13 is in a state being engaged with the cover 11), separate the first container 13 from the cover 11, and then remove the second container 14 and the utensils. At this time, each of the first container 13 and the second container 14 is in a folded state, and the user may push the bottom portions 134 and 144 of the first container 13 and the second container 14 outward respectively, and expand the first container 13 and the second container 14 to fully expand them as shown in FIGS. 6 and 7 with the elastic force generated by the elastic deformation of the middle portions 133 and 143.

To store the container set, the user may place the first container 13 and the second container 14 on a plane and press the top portions 132 and 142 of the first container 13 and the second container 14 downward to restore the first container 13 and the second container 14 to the folded state as shown in FIGS. 2 and 4.

The foregoing interlocking structure of the invention enables multiple containers to be tightly assembled, prevents leakage, and enables the multiple containers to be stacked in an orderly and stable manner. In addition, as shown in FIG. 4, additional container(s) and/or utensils, such as knives, forks, spoons, etc., can be further accommodated between the containers, thereby optimizing the space utilization of the container set.

The embodiments set forth above may be liable to minor modifications based on the spirit of the invention. However, the invention with minor modifications based on the spirit of the invention should be deemed to lie within the scope of protection. Further, the above descriptions are intended only for elaboration but not to limit the invention.

What is claimed is:

1. A container set, comprising:

a cover and a base, the cover having a cover sealing member, wherein the cover sealing member is made of elastic material and protrudes from a cover peripheral edge of the cover to allow the cover to engage the base;

wherein the cover sealing member protrudes outward along the cover peripheral edge to allow the cover to engage an inner surface of the base; and the inner surface of the base has a base groove to allow the cover sealing member to engage the base groove when the cover engages the base; and a first container having a container edge to allow the first container to engage an inner surface of the cover;

wherein the cover sealing member extends along the cover peripheral edge and protrudes inward, and the container edge extends along a peripheral edge of the first container and protrudes outward to allow the first container to engage the cover through engagement between the container edge and the cover sealing member.

2. The container set of claim 1, wherein the container edge, the cover sealing member and the base groove constitute an interlocking structure.

3. The container set of claim 2, wherein when the container edge engages the cover sealing member and when the cover sealing member engages the base groove, both the container edge and the base groove abut against the cover sealing member so that a seal is formed by the interlocking structure resulting from an elastic deformation of the cover sealing member.

4. The container set of claim 1, further comprising a second container placed between the first container and the cover.

5. The container set of claim 1, wherein an inner surface of the cover sealing member forms a cover groove extending along the cover peripheral edge, and when the first container engages the cover, the container edge engages the cover groove.

6. The container set of claim 5, wherein the cover groove is defined by at least one inner projection of the cover sealing member and the inner surface of the cover.

7. The container set of claim 1, wherein the elastic material is silicon rubber.

8. The container set of claim 1, wherein the elastic material is attached to the cover sealing member by coating.

9. The container set of claim 4, wherein the first container and the second container are foldable and each of the first container and the second container includes:

a bottom portion and a top portion made of a first material;

a middle portion made of a second material and having at least two folding segments;

wherein the middle portion is located between the bottom portion and the top portion and is connected to a top edge of the bottom portion and a bottom edge of the top portion respectively, and wherein the first material has a higher Young's modulus than the second material.

10. The container set of claim 9, wherein the second material is silicon rubber.

11. The container set of claim 10, wherein the at least two folding segment comprises a first folding segment and a second folding segment, the first folding segment is located adjacent to a position where the middle portion and the bottom portion join, and the second folding segment is located adjacent to a position where the middle portion and the top portion join; and wherein when the first container and the second container are folded, the first folding segment and the second folding segment are elastically deformed so that the bottom portion is folded and received at an inner side of the top portion, and the middle portion is folded between the top portion and the bottom portion.

12. The container set of claim 1, wherein the cover has a gas valve.

13. The container set of claim 1, further comprising at least one utensil placed between the first container and the base.

* * * * *